US012583703B2

(12) United States Patent
Kawamoto et al.

(10) Patent No.: US 12,583,703 B2
(45) Date of Patent: Mar. 24, 2026

(54) SHEET CONVEYING DEVICE, AUTOMATIC DOCUMENT FEEDER, AND IMAGE FORMING APPARATUS

(71) Applicants: Kota Kawamoto, Kanagawa (JP); Yasunobu Youda, Kanagawa (JP)

(72) Inventors: Kota Kawamoto, Kanagawa (JP); Yasunobu Youda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 170 days.

(21) Appl. No.: 18/239,756

(22) Filed: Aug. 30, 2023

(65) Prior Publication Data

US 2024/0067485 A1 Feb. 29, 2024

(30) Foreign Application Priority Data

Aug. 31, 2022 (JP) ..... 2022-138279

(51) Int. Cl.
*B65H 29/12* (2006.01)

(52) U.S. Cl.
CPC ..... *B65H 29/125* (2013.01); *B65H 2404/144* (2013.01); *B65H 2405/3321* (2013.01); *B65H 2511/14* (2013.01); *B65H 2601/11* (2013.01); *B65H 2801/39* (2013.01)

(58) Field of Classification Search
CPC .. B65H 29/125; B65H 5/062; B65H 2511/14; B65H 2601/11
See application file for complete search history.

(56) References Cited

U.S. PATENT DOCUMENTS

| | | | | |
|---|---|---|---|---|
| 6,147,781 | A | 11/2000 | Tanaka et al. | |
| 6,182,964 | B1 | 2/2001 | Tanaka et al. | |
| 6,311,973 | B1 | 11/2001 | Tanaka et al. | |
| 8,342,522 | B2 * | 1/2013 | Maeno | B65H 9/006 271/272 |
| 8,587,848 | B2 * | 11/2013 | Nose | H04N 1/00602 358/496 |
| 10,048,632 | B2 * | 8/2018 | Suto | G03G 15/6529 |
| 10,686,955 | B2 * | 6/2020 | Yamada | B65H 31/00 |
| 2005/0194730 | A1 | 9/2005 | Nishida et al. | |
| 2009/0162082 | A1 | 6/2009 | Shiraki et al. | |
| 2010/0149299 | A1 | 6/2010 | Nishida et al. | |
| 2012/0104676 | A1 | 5/2012 | Hatayama et al. | |
| 2013/0222826 | A1 | 8/2013 | Osanai et al. | |
| 2016/0127590 | A1 | 5/2016 | Hatayama et al. | |
| 2016/0360073 | A1 | 12/2016 | Hatayama et al. | |

(Continued)

FOREIGN PATENT DOCUMENTS

| | | | |
|---|---|---|---|
| JP | H07-309045 | A | 11/1995 |
| JP | 2011-152789 | A | 8/2011 |

(Continued)

*Primary Examiner* — Patrick Cicchino
(74) *Attorney, Agent, or Firm* — XSENSUS LLP

(57) ABSTRACT

A sheet conveying device includes a housing, an opening unit, and a drive rotator. The opening unit is openably close the housing, the opening unit including a driven rotator including first driven rollers at each end regions of an axis of the driven rotator, and a second driven roller at a center region of the axis. The drive rotator forms a conveyance roller pair with the driven rotator to convey a sheet. The second driven roller has an outer diameter greater than each of the first driven rollers.

11 Claims, 9 Drawing Sheets

(56) References Cited

U.S. PATENT DOCUMENTS

| | | | |
|---|---|---|---|
| 2016/0368728 | A1 | 12/2016 | Hirata et al. |
| 2017/0142265 | A1 | 5/2017 | Horikawa et al. |
| 2017/0351209 | A1 | 12/2017 | Nagano et al. |
| 2018/0086579 | A1 | 3/2018 | Andoh et al. |
| 2018/0270375 | A1 | 9/2018 | Imaki et al. |
| 2019/0047809 | A1 | 2/2019 | Hirata et al. |
| 2019/0283989 | A1 | 9/2019 | Tada et al. |

FOREIGN PATENT DOCUMENTS

| | | | | | |
|---|---|---|---|---|---|
| JP | 2017-130860 | A | | 7/2017 | |
| JP | 2018-131325 | A | | 8/2018 | |
| JP | 2023111182 | A | * | 8/2023 | ..... B65H 29/125 |

* cited by examiner

COMPARATIVE EXAMPLE

COMPARATIVE EXAMPLE

SHEET CONVEYING DEVICE, AUTOMATIC DOCUMENT FEEDER, AND IMAGE FORMING APPARATUS

CROSS-REFERENCE TO RELATED APPLICATION

This patent application is based on and claims priority pursuant to 35 U.S.C. § 119(a) to Japanese Patent Application No. 2022-138279, filed on Aug. 31, 2022, in the Japan Patent Office, the entire disclosure of which is hereby incorporated by reference herein.

BACKGROUND

Technical Field

Embodiments of the present disclosure relate to a sheet conveying device, an automatic document feeder, and an image forming apparatus.

Background Art

Sheet conveying devices are known that include a conveyance rotator pair including a drive rotator and a driven rotator to nip and convey a sheet.

A sheet conveying device in the art includes a driven roller serving as a driven rotator that is disposed in an openable guide unit serving as an openable and closable member facing a sheet back face reader that reads an image on a back face of an original document.

SUMMARY

Embodiments of the present disclosure described herein provide a novel sheet conveying device including a housing, an opening unit, and a drive rotator. The opening unit is openably close the housing, the opening unit including a driven rotator including first driven rollers at each end regions of an axis of the driven rotator, and a second driven roller at a center region of the axis. The drive rotator forms a conveyance roller pair with the driven rotator to convey a sheet. The second driven roller has an outer diameter greater than each of the first driven rollers.

Further, embodiments of the present disclosure described herein provide an automatic document feeder including the above-described sheet conveying device to convey a document sheet, and an image reader to read an image on a face of the document sheet conveyed by the sheet conveying device.

Further, embodiments of the present disclosure described herein provide an image forming apparatus including the above-described automatic document feeder to convey a sheet, and an image former to form an image on the sheet conveyed by the automatic document feeder.

Further, embodiments of the present disclosure described herein provide an image forming apparatus including the above-described sheet conveying device to convey a sheet, and an image former to form an image on the sheet conveyed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
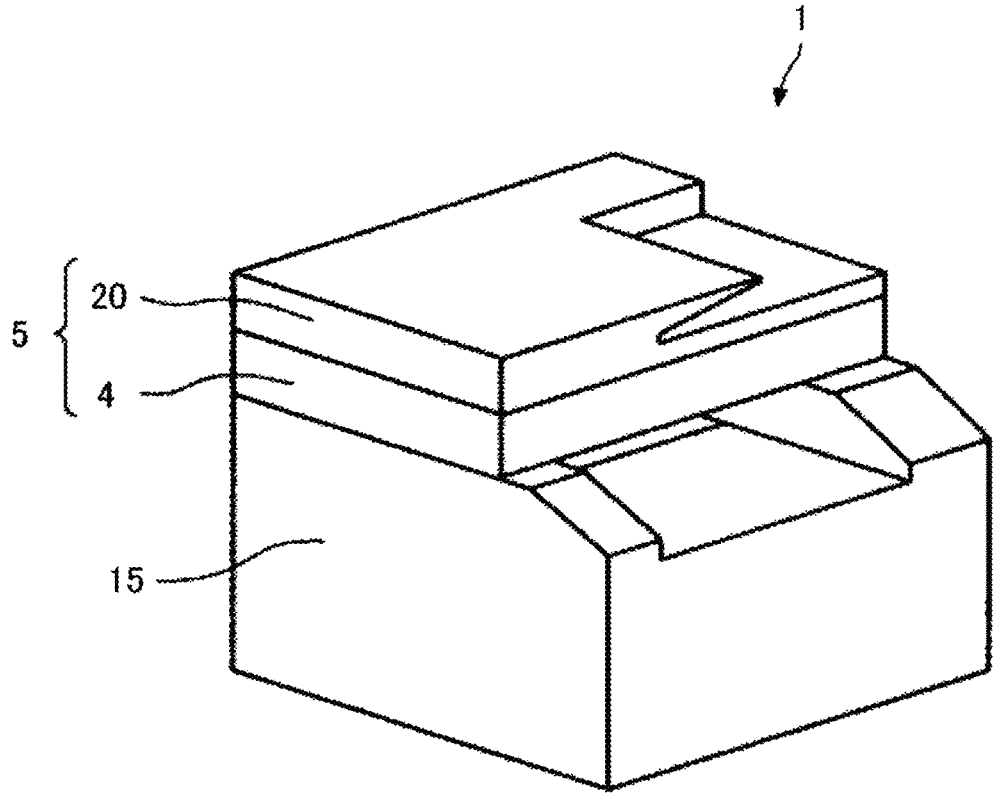
FIG. 1 is a perspective view of an image forming apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against." "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of an image forming apparatus including an image reading device, according to an embodiment of the present disclosure.

FIG. 1 is a perspective view of an image forming apparatus 1 according to an embodiment of the present disclosure.

The image forming apparatus 1 illustrated in FIG. 1 is a multifunctional image forming apparatus including the functions of, for example, copier, printer, facsimile machine, and scanner. The image forming apparatus 1 can record a full-color image or a monochrome image based on input data such as read image data and output the full-color image or the monochrome image onto a recording sheet or in a predetermined data method.

As illustrated in FIG. 1, the image forming apparatus 1 includes an automatic document feeder (ADF) 20 disposed above a sheet feeding device, a scanner 4, and an image forming device 15. The scanner 4 and the ADF 20 are included in an image reading device 5.

The sheet feeding device of the image forming device 15 includes multistage sheet trays each of which accommodates, for example, cut recording sheets, and multiple sheet feed rollers each of which picks up a recording sheet from a corresponding sheet tray of the multistage sheet trays to feed the recording sheet. The sheet feeding device further includes a sheet conveyance passage provided with various rollers to convey the recording sheet fed from the corresponding sheet tray of the multistage sheet trays to a given image forming position of the image forming device 15.

The image forming device 15 includes, for example, an exposure unit, multiple photoconductor drums, developing devices, a transfer belt, a secondary transfer unit, and a fixing device. The developing devices develop toner images by supplying respective toner colors of cyan (C), magenta (M), yellow (Y), and black (K).

Based on image data read by the image reading device 5, the exposure device of the image forming device 15 exposes the photoconductor drums to form respective electrostatic latent images on the photoconductor drums. Then, respective developer units of the developing devices supply toners of respective colors onto the electrostatic latent images to develop the electrostatic latent images into visible toner images. Further, the image forming device 15 causes the respective toner images formed on the photoconductor drums to be primarily transferred onto the transfer belt. Then, the toner images are secondarily transferred and overlaid onto a recording sheet at the secondary transfer unit. After the respective toner images are overlaid to form a composite toner image on the recording sheet, the fixing device fixes the toner image to the recording sheet by application of heat and pressure to form a color image on the recording sheet. Further, the image forming device 15 forms an external output image, for example, an image file or data that can be output to an external device, based on the image read by the scanner 4 or a sheet back face image reading module 35 (i.e., a second image reader) which will be described below. The image forming device 15 is not limited to an electrophotographic image forming device as described above. An image forming device applicable to the present disclosure may employ a different method such as an inkjet image forming device.

A description is now given of the image reading device 5.

Figure 2:
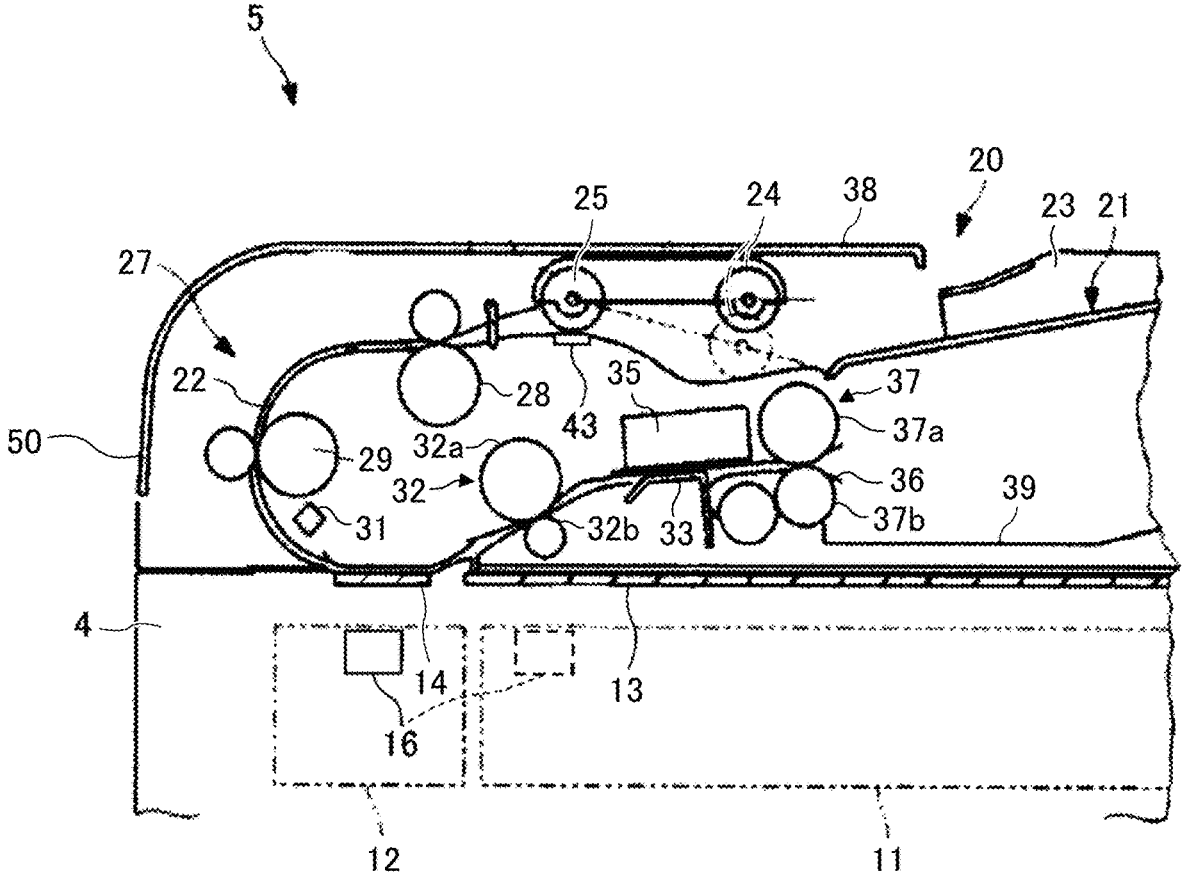
FIG. 2 is an enlarged diagram illustrating a configuration of an image reading device included in the image forming apparatus of FIG. 1.

FIG. 2 is an enlarged diagram illustrating a configuration of the image reading device 5.

The image reading device 5 performs an image reading operation by switching between a flatbed scanner mode (stationary document reading mode) and a DF scanner mode (feeding document reading mode).

The flatbed scanner mode is an operation mode to read an image on an original document placed on a flatbed exposure glass 13 in the upper part of the scanner 4. The flatbed scanner mode is executed when a reading start request operation such as pressing of a copy start button is performed in a state where an original document is placed on the flatbed exposure glass 13 in the upper portion of the scanner 4. Light is emitted to the image forming face of the original document while an image reading unit 16 is moving in a movable document reading area 11 immediate below the flatbed exposure glass 13. The image reading unit 16 reads the image on the original document by converting the light reflected on the image forming face of the original document, into an image signal.

The DF scanner mode is an operation mode to read the image on the original document being fed in the image reading unit 16 by causing the image reading unit 16 to stop at a stationary document reading area 12 immediate below the DF exposure glass 14.

In the DF scanner mode, the ADF 20 separates an original document one by one from a bundle of original documents loaded on a document stacking tray 21 (i.e., a document loading table), causes the separated original document to enter a document conveyance passage 22, and conveys the original document along the document conveyance passage 22. While being conveyed along the document conveyance passage 22, the original document is brought to the DF exposure glass 14 to face the upper face of the DF exposure glass 14 sequentially and partly from the leading end of the original document in the document conveyance direction.

The ADF 20 is attached to a rear part (a back face) of an upper face of the scanner 4 via an opening and closing mechanism such as a hinge or hinges. The ADF 20 moves between an open position at which the flatbed exposure glass 13 is open relative to the scanner 4 and a closed position at which the ADF 20 presses an original document placed on the flatbed exposure glass 13.

The image reading unit 16 may be a reading unit, for example, a charge-coupled device (CCD) module or a contact image sensor (CIS) module, to read an image on the front face of an original document by repeatedly performing line scanning, in other words, scanning the image in line, at a given image reading position on the flatbed exposure glass 13 and the DF exposure glass 14. The image reading unit 16 may separately include a fixed reading unit that is fixed to the stationary document reading area 12 and a movable reading unit that is movable in the movable document reading area 11 along the flatbed exposure glass 13.

The document stacking tray 21 is provided with side fences 23 that is a pair of side fences. The side fences 23 are movable in the width direction of an original document for positioning the original documents set in the ADF 20 in the width direction that is orthogonal to the sheet conveyance direction. The side fences 23 are relatively movable to approach each other or separate from each other, so as to match the center of the document stacking tray 21 and the center of the original document in the width direction of the original document.

The ADF 20 is covered by a cover 38 that is disposed openably closable. The cover 38 covers at least an upper side of the ADF 20.

The ADF 20 has the main guide part that forms the document conveyance passage 22. The main guide part of the ADF 20 is defined by ribs formed by the cover 38. The ADF 20 further includes a pickup roller 24, a feed roller 25, and a separation pad 43. The pickup roller 24 picks up the original document set on the document stacking tray 21 to feed the original document in the sheet conveyance direction. The feed roller 25 and the separation pad 43 feed the original document picked up by the pickup roller 24 in the sheet conveyance direction, toward the document conveyance passage 22.

The ADF 20 further includes a document conveying device 27 that conveys the original document fed by the feed roller 25 into the document conveyance passage 22, onto the DF exposure glass 14, in a posture in which the original document is ready to be read. After the image of the original document is read, the document conveying device 27 then conveys the original document to a document ejection port 36.

The document conveying device 27 reverses the original document separated and conveyed by, for example, the feed roller 25 along the document conveyance passage 22 and conveys the original document so that the original document passes a given reading position on the upper face of the DF exposure glass 14. Due to such document conveyance, the ADF 20 further includes a first conveyance roller 28, a second conveyance roller 29, and a registration sensor 31, each being disposed upstream from the DF exposure glass 14 along the document conveyance passage 22 in the conveyance direction. The registration sensor 31 detects the leading end of the original document in the sheet conveyance direction.

The original document separated by, for example, the feed roller 25 is conveyed so as to pass over the DF exposure glass 14 by the first conveyance roller 28 and the second conveyance roller 29. Then, an image on the front face of the original document is timely read by the image reading unit 16, based on the timing of detection of the leading end of the original document by the registration sensor 31.

For example, when the leading end of the original document is detected by the registration sensor 31, the timing at which the position of the leading end of the original document detectable by the pulse count of the sheet feeding motor serving as a drive source reaches the reading position on the DF exposure glass 14 is specified. Transmission of gate signals each indicating an effective image area in the sub-scanning direction on the front face of the original document is started. The transmission of the gate signals is continued until the position of the trailing end of the original document passes through the reading position.

When the reading of an image on the back face of the original document is requested, the image on the back face of the original document is read by a sheet back face image reading module 35 (i.e., a second image reader) including contact image sensors for reading an image on the back face of the original document.

The sheet back face image reading module 35 includes a light source unit, multiple sensor chips, and multiple amplification units. The light source unit that irradiates the original document with light based on a lighting signal from the controller. The multiple sensor chips receive reflected light from the original document. The multiple amplification units amplify signals output from the sensor chips. The sheet back face image reading module 35 also includes an analog-to-digital (A/D) converter and an image processor. The A/D converter converts the signal amplified by the amplification unit from an analog signal to a digital signal. The image processor performs image processing on the digitally converted signal. The sheet back face image reading module 35 further includes, for example, an output control circuit and an interface circuit. The output control circuit performs output control of the signal stored in the frame memory based on a timing signal from the controller. The interface circuit outputs the signal from the output control circuit to the image forming apparatus. The timing of reading the back face of the original document by the sheet back face image reading module 35 is controlled at substantially the same timing of reading the front face of the original document. After completion of image reading, the original document is ejected to an ejection tray 39.

A reader exit roller pair 32 is disposed downstream from the DF exposure glass 14 in the document conveyance passage 22 in the sheet conveyance direction. The reader exit roller pair 32 serves as a rotary sheet conveyor pair that conveys the original document with the image on the front face being read, toward the sheet back face image reading module 35. A white guide 33 serving as a guide member facing the sheet back face image reading module 35 is disposed downstream from the reader exit roller pair 32 in the sheet conveyance direction. Further, a sheet ejection roller pair 37 serving as a rotary sheet conveyor is disposed downstream from the sheet back face image reading module 35 and the white guide 33 in the sheet conveyance direction.

The white guide 33 has a guide function of moving the conveyed original document along the sheet back face image reading module 35, and has a white reference plane for shading correction disposed to face the sheet back face image reading module 35 over the full region in the main scanning direction.

The number of rollers for conveying and ejecting original documents and the positions of these rollers can be freely determined according to setting conditions of the document conveyance passage 22 and the length in the conveyance direction of the original documents having the smallest size.

The sheet back face image reading module 35 uses contact image sensors having a shallow depth of focus, and conveys the original document with the back side in contact with a glass face of the sheet back face image reading module 35. Due to such a configuration, for example, paper dust of the original document or toner on the image of the original document adheres to the glass face of the sheet back face image reading module 35, and the glass face can easily be contaminated. For this reason, it is likely that an abnormal condition such as black streaks on the image read by the sheet back face image reading module 35 due to the dirt on the glass face. Accordingly, the glass face needs to be regularly cleaned. In the present embodiment, in order to clean the glass face, the openable guide unit 100 that is openably and closably disposed on a housing 50 of the ADF 20 to expose the document conveyance passage 22 between the DF exposure glass 14 and the document ejection port 36. Note that the housing 50 of the ADF 20 also serves as a housing of the document conveying device 27.

Figure 3:
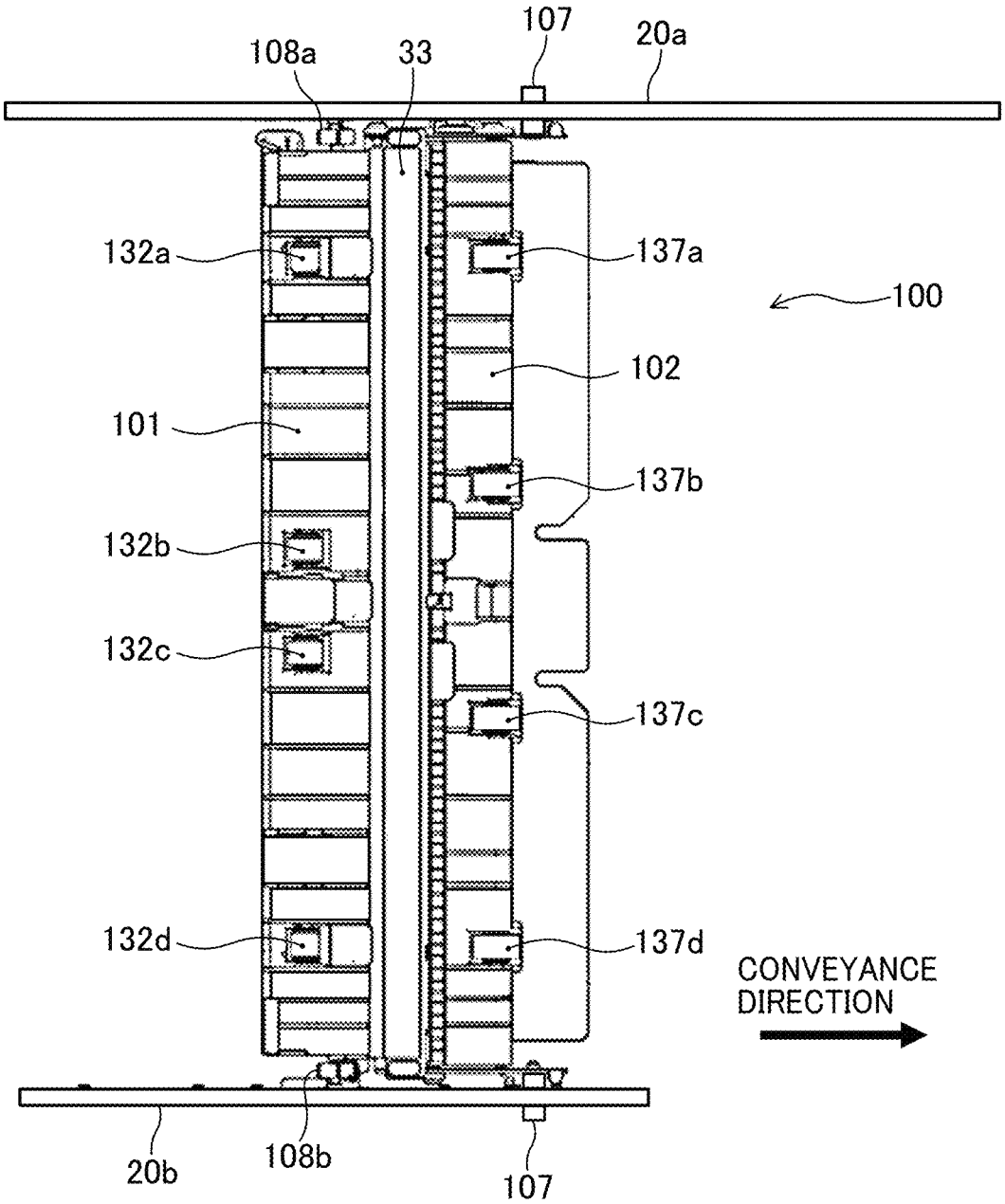
FIG. 3 is a top view of an openable guide unit included in the image reading device of FIG. 2.

FIG. 3 is a top view of the openable guide unit 100 viewed from above.

Figure 4:
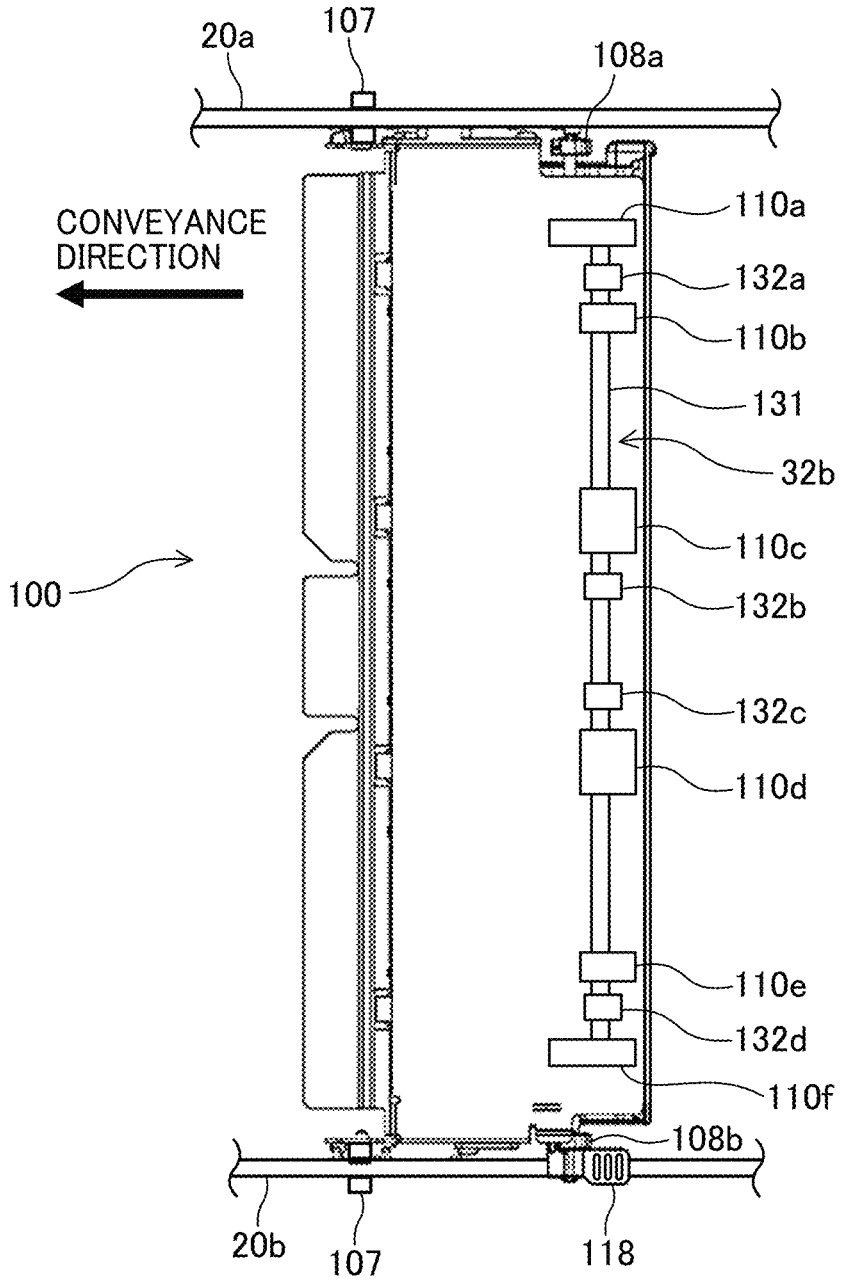
FIG. 4 is a bottom view of the openable guide unit included in the image reading device of FIG. 2.

FIG. 4 is a bottom view of the openable guide unit 100 viewed from below.

The openable guide unit 100 serving as an opening unit includes three guides. Specifically, the openable guide unit 100 includes an exit lower guide plate 101, a white guide 33, and an ejection lower guide plate 102, which guide the original document that has passed the DF exposure glass 14 to the sheet back face image reading module 35. The openable guide unit 100 further includes a reader exit driven roller unit 32*b* and an ejection driven roller 37*b*. The reader exit driven roller unit 32*b* serves as a driven rotator of the reader exit roller pair 32. The ejection driven roller 37*b* serves as a driven rotator of the sheet ejection roller pair 37.

As illustrated in FIG. 4, the reader exit driven roller unit 32*b* of the reader exit roller pair 32 includes a driven shaft 131 and exit driven rollers 132*a*, 132*b*, 132*c*, and 132*d*. The exit driven rollers 132*a*, 132*b*, 132*c*, and 132*d* are multiple driven rollers attached to the driven shaft 131. The driven shaft 131 and the exit driven rollers 132*a*, 132*b*, 132*c*, and 132*d* are rotatably held by the exit lower guide plate 101. The reader exit driven roller unit 32*b* is biased by multiple pressing members 110*a* to 110*f* toward the reader exit drive roller unit 32*a*.

The ejection driven roller 37*b* of the sheet ejection roller pair 37 has the similar configuration to the configuration of the reader exit driven roller unit 32*b*. Specifically, the ejection driven roller 37*b* of the sheet ejection roller pair 37 includes a driven shaft and multiple ejection driven rollers 137*a*, 137*b*, 137*c*, and 137*d* attached to the driven shaft. The ejection driven roller 37*b* is rotatably held by the ejection lower guide plate 102.

As illustrated in FIG. 3, a part of each of the exit driven rollers 132*a*. 132*b*, 132*c*, and 132*d* of the reader exit driven roller unit 32*b* protrudes from a corresponding roller exposure opening formed in the guide surface of the exit lower guide plate 101. Accordingly, the exit driven rollers 132*a*, 132*b*, 132*c*, and 132*d* of the reader exit driven roller unit 32*b* can be brought into contact with the exit drive rollers 134*a*, 134*b*, 134*c*, and 134*d* (see FIG. 7) of the reader exit drive roller unit 32*a*. Similarly, a part of each of the ejection driven rollers 137*a*, 137*b*, 137*c*, and 137*d* of the ejection driven roller 37*b* protrudes from a corresponding roller exposure opening formed in the guide surface of the ejection lower guide plate 102 and can contact the drive roller of the ejection drive roller 37*a*.

Support shafts 107 are provided at both axial ends of the openable guide unit 100 on the downstream ends in the sheet conveyance direction of the original document. The support shafts 107 are rotatably fitted in a rear side frame 20*a* and a front side frame 20*b* of the ADF 20. The openable guide unit 100 is attached to the ADF 20 so as to be rotatable about the support shafts 107 as a fulcrum.

The openable guide unit 100 is provided with a lock mechanism that locks the openable guide unit 100 at the closed position. The lock mechanism includes a rotary shaft and lock levers 108*a* and 108*b*. The rotary shaft is rotatably supported by the exit lower guide plate 101. The lock levers 108*a* and 108*b* are fixed to both ends of the rotary shaft. The lock levers 108*a* and 108*b* have the same basic configuration. However, as illustrated in FIG. 4, the lock lever 108*b* on the front side of the ADF 20, in other words, on one axial end of the ADF 20 is provided with an operation portion 118 through which a user operates.

Figure 5A:
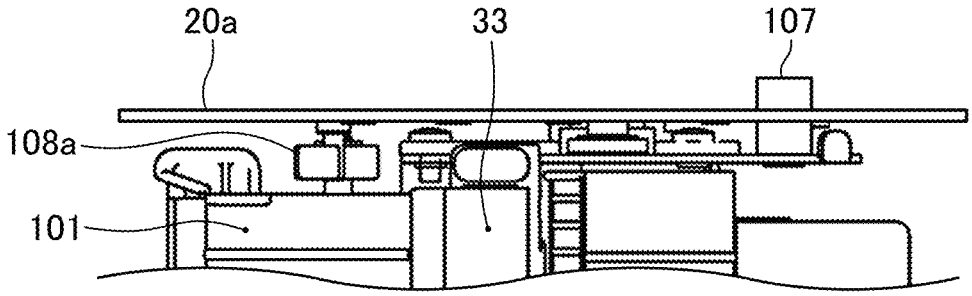
FIGS. 5A and 5B are diagrams each illustrating a state where the openable guide unit is locked to a closed position by a lock lever disposed on the distal side from the front face of the image forming apparatus.
Figure 5B:
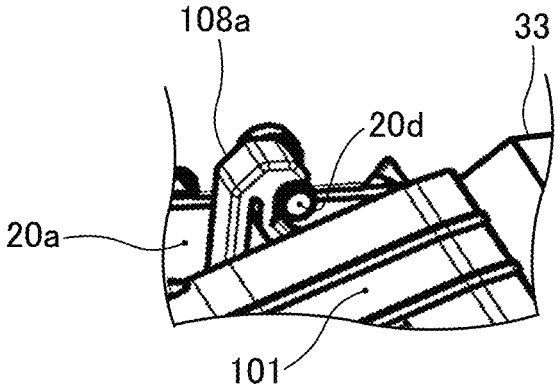

FIGS. 5A and 5B are diagrams each illustrating a state where the openable guide unit 100 is locked to a closed position by the lock lever 108*a* disposed on the distal side from the front face of the image forming apparatus.

The rear side frame 20*a* of the ADF 20 includes a hook projection 20*d* extending toward the inside of the ADF 20. By hooking the hook portion of the lock lever 108*a* to the hook projection 20*d*, the openable guide unit 100 is locked at the closed position. The rotary shaft on which the lock lever 108*a* is mounted is biased by a torsion spring so that the engagement of the hook portion of the lock lever 108*a* and the hook projection 20*d* does not disengaged, in other words, so that the hook portion of the lock lever 108*a* remains engaged with the hook projection 20*d*. The configuration of the lock lever 108*b* on the front side of the ADF 20 has the basically same configuration as the lock lever 108*a* on the rear side of the ADF 20.

When the openable guide unit 100 is unlocked, a user operates the operation portion 118 (see FIG. 4) of the lock lever 108*b* on the front side of the ADF 20 to rotate the lock mechanism in the direction opposite to the biasing direction of the torsion spring. As a result, the hook projection 20*d* and each of the hook portions of the lock levers 108*a* and 108*b* are disengaged, and the openable guide unit 100 becomes rotatable to the open position.

Figure 6A:
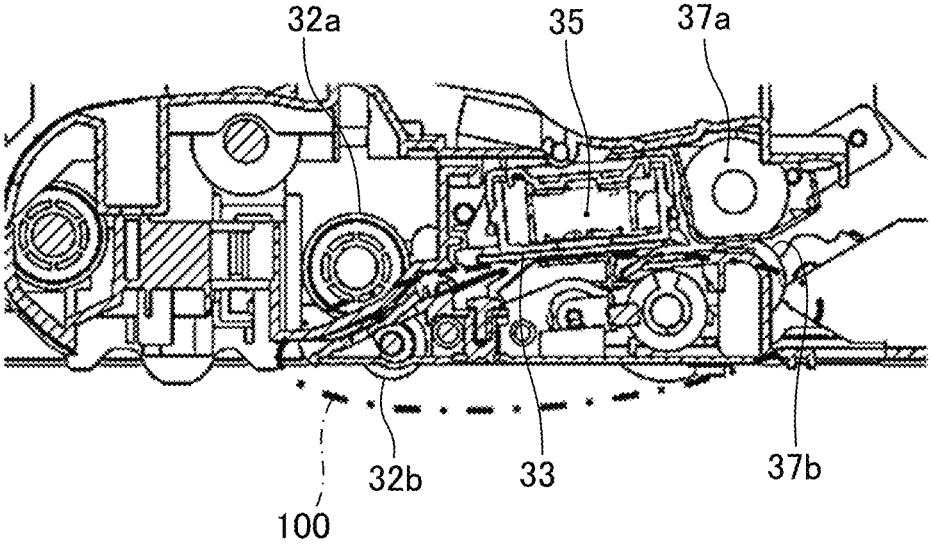
FIGS. 6A and 6B are diagrams each illustrating opening and closing of the openable guide unit.
Figure 6B:
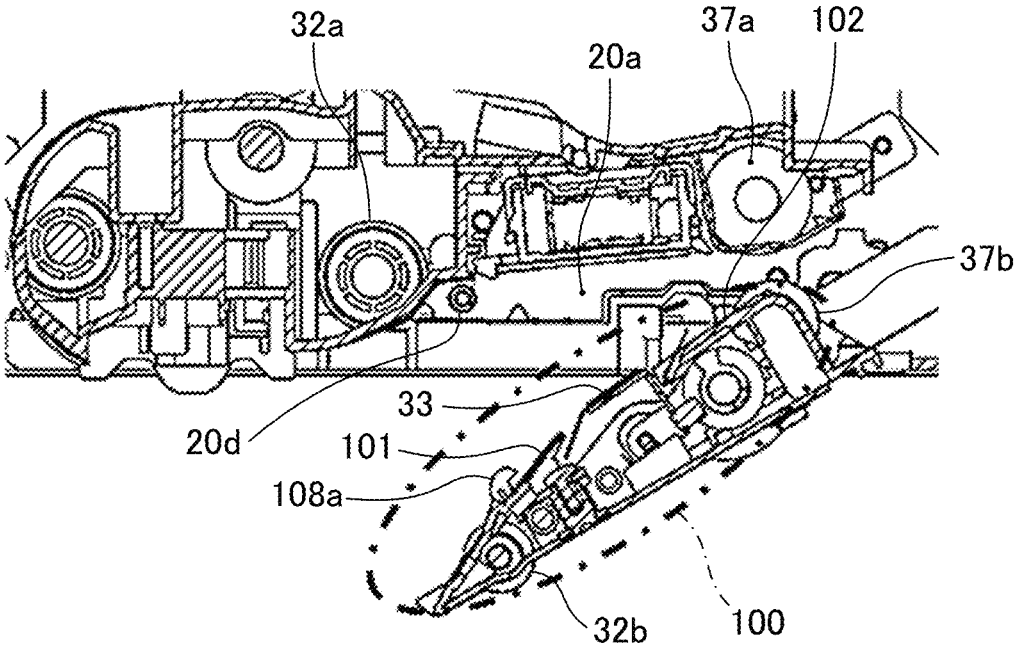

FIG. 6A illustrates a state where the openable guide unit 100 is at the closed position. FIG. 6B illustrates a state where the openable guide unit 100 is at the open position.

As illustrated in FIG. 6A, the openable guide unit 100 at the closed position is enclosed in the ADF 20. When the openable guide unit 100 is at the closed position, the reader exit driven roller unit 32*b* (specifically, the rollers of the reader exit driven roller unit 32*b*) contacts the reader exit drive roller unit 32*a* (specifically, the rollers of the reader exit drive roller unit 32*a*) to form the conveyance nip region (i.e., the conveyance nip regions). Further, the ejection driven roller 37*b* (specifically, the rollers of the ejection driven roller 37*b*) contacts the ejection drive roller 37*a* (specifically, the rollers of the ejection drive roller 37*a*) to form the conveyance nip region (i.e., the conveyance nip regions).

When cleaning the glass surface of the sheet back face image reading module 35 or when removing an original document jammed in the document conveyance passage between the DF exposure glass 14 and the document ejection port 36, the openable guide unit 100 is moved to open position.

When moving the openable guide unit 100, the ADF 20 is initially moved to the open position to open over the flatbed exposure glass 13. Then, the user operates the operation portion 118 (see FIG. 4) of the lock lever 108*b* of the lock mechanism on the front side of the ADF 20 to release the locking of the openable guide unit 100. Then, by rotating the openable guide unit 100 around the support shaft 107 as a fulcrum in the counterclockwise direction in FIGS. 6A and 6B, the openable guide unit 100 moves to the open position as illustrated in FIG. 6B.

As illustrated in FIG. 6B, as the openable guide unit 100 is at the open position, the document conveyance passage is opened from the DF exposure glass 14 to the document ejection port 36, which exposes the glass surface of the sheet back face image reading module 35. With the above-described procedures, the glass surface of the sheet back face image reading module 35 can be cleaned.

As illustrated in FIG. 6B, as the openable guide unit 100 is at the open position, the reader exit driven roller unit 32*b* is separated from the reader exit drive roller unit 32*a*, and the ejection driven roller 37*b* is separated from the ejection drive roller 37*a*. As a result, the original document jammed in the document conveyance passage between the DF exposure glass 14 and the document ejection port 36 can be easily removed without damaging the jammed original document.

Figure 7:
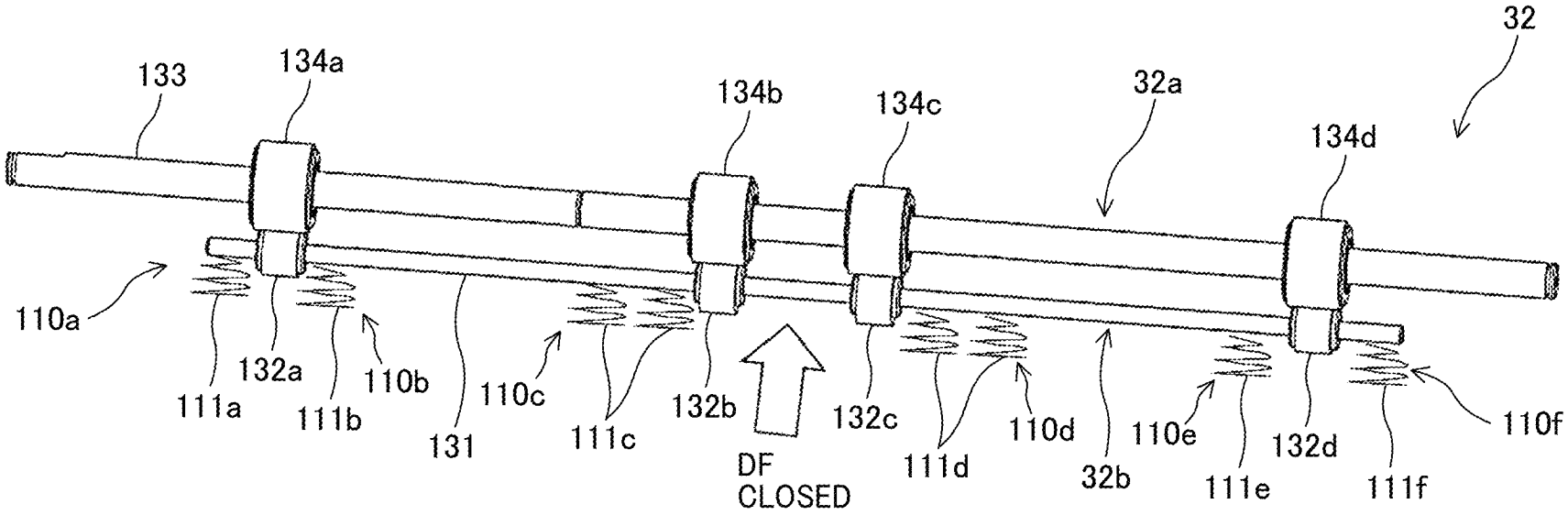
FIG. 7 is a perspective view of a reader exit roller pair.

FIG. 7 is a perspective view of the reader exit roller pair 32.

The reader exit drive roller unit 32*a* serving as a drive rotator of the reader exit roller pair 32 includes a drive shaft 133, and the exit drive rollers 134*a*. 134*b*, 134*c*, and 134*d* serving as multiple drive rollers attached to the drive shaft 133. In the present embodiment, two of the exit drive rollers 134*a*. 134*b*, 134*c*, and 134*d* are disposed at both axial ends and the other two of the exit drive rollers 134*a*, 134*b*, 134*c*, and 134*d* are disposed on the axial center region. The exit drive rollers 134*a*, 134*b*, 134*c*, and 134*d* are disposed symmetrically with respect to the axial center as a base point. The outer diameters of the exit drive rollers 134*a*, 134*b*, 134*c*, and 134*d* are the same so that the circumferential velocities of the exit drive rollers 134*a*, 134*b*, 134*c*, and 134*d* are the same. As a result, the original documents can be conveyed at a uniform conveyance speed in the axial direction, occurrence of, for example, wrinkles in the original documents can be prevented, and the original document can be stably conveyed.

The reader exit driven roller unit 32*b* includes the driven shaft 131 and four exit driven rollers 132*a*, 132*b*, 132*c*, and 132*d*. The exit driven rollers 132*a*. 132*b*, 132*c*, and 132*d* are mounted on the driven shaft 131 and correspond to the exit drive rollers 134*a*. 134*b*, 134*c*, and 134*d*, respectively. Specifically, two of the exit driven rollers 132*a*, 132*b*, 132*c*, and 132*d* are disposed at both axial ends and the other two of the exit driven rollers 132*a*, 132*b*, 132*c*, and 132*d* are disposed on the axial center region. The exit driven rollers 132*a*. 132*b*, 132*c*, and 132*d* are disposed symmetrically with respect to the axial center as a base point.

In the present embodiment, the reader exit drive roller unit 32*a* and the reader exit driven roller unit 32*b* are multiple rollers axially aligned at given intervals. By so doing, skew occurring due to an external factor such as a conveyance load can be prevented.

The driven shaft 131 is biased toward the reader exit drive roller unit 32*a* by springs 111*a* to 111*f* (e.g., compression springs) serving as biasing members of the pressing members 110*a* to 110*f*. By biasing the driven shaft 131 as described above, the exit driven rollers 132*a*, 132*b*, 132*c*, and 132*d* are pressed against the corresponding exit drive rollers 134*a*. 134*b*. 134*c*, and 134*d*, respectively, to form respective conveyance nip regions. The original document fed into the conveyance nip regions is pressed against the exit drive rollers 134*a*. 134*b*, 134*c*, and 134*d* by the exit driven rollers 132*a*, 132*b*, 132*c*, and 132*d*, respectively. As a result, a target friction force (hereinafter, referred to as a conveyance force) is generated between the original document and each of the exit drive rollers 134*a*, 134*b*, 134*c*, and 134*d*, so that the original document is conveyed.

It is preferable that the relation of the conveyance forces is expressed as the rollers at the center regions≥the rollers at the end regions. In other words, it is preferable that the conveyance force of the rollers at the center regions is equal to or greater than the conveyance force of the rollers at the end regions.

If the relation of the conveyance forces is expressed as the rollers at the center regions<the rollers at the end regions, in other words, if the conveyance force of the rollers at the center regions is smaller than the conveyance force of the rollers at the end regions, skew is likely to occur with a slight difference between the conveyance force at one end region and the conveyance force at the other end region. For this reason, the above-described relation of the conveyance forces is preferable. In the present embodiment, the biasing force of the multiple pressing members 110*a* to 110*f* to the driven shaft 131 is set so that the conveyance force of the rollers at the center region: the conveyance force of the rollers at the end regions is 2:1.

Figure 8A:
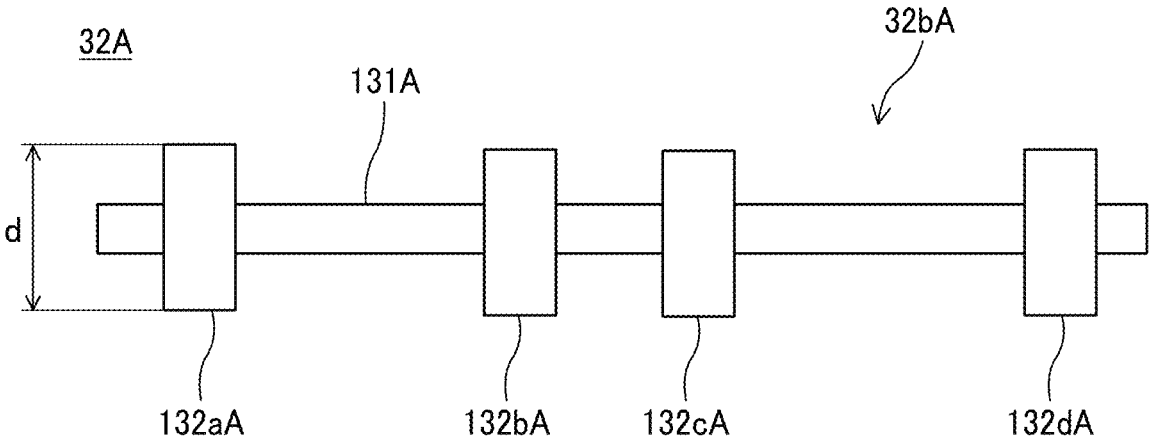
FIGS. 8A and 8B are diagrams each illustrating a reader exit roller pair in the art.
Figure 8B:
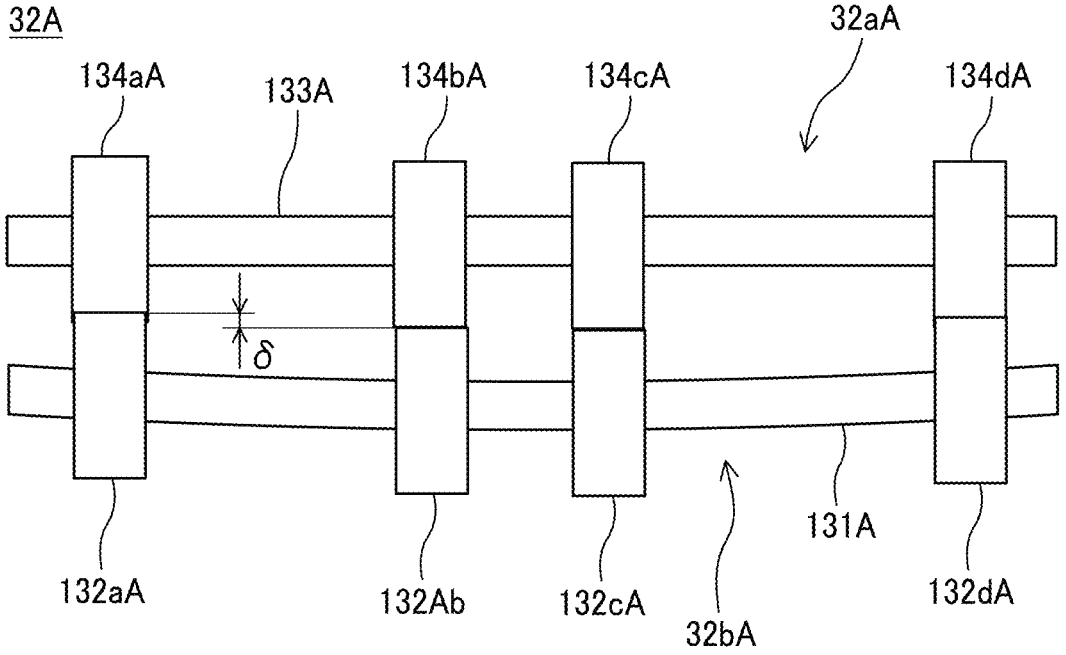

FIGS. 8A and 8B are diagrams each illustrating a known reader exit roller pair 32A in the art as a comparative example.

Specifically, FIG. 8A illustrates a schematic configuration of a reader exit driven roller unit 32*b*A of the known reader exit roller pair 32A, and FIG. 8B illustrates a schematic configuration of the reader exit roller pair 32A in the art when the reader exit roller pair 32A has a failure.

As illustrated in FIG. 8A, the reader exit driven roller unit 32*b*A of the reader exit roller pair 32A includes exit driven rollers 132*a*A, 132*b*A, 132*c*A, and 132*d*A having the same outer diameter "d".

The openable guide unit 100 is openably closable and is held at both axial ends of the ADF 20. Due to such a configuration, the axial center region is easily warped downward. When the openable guide unit 100 is warped, as illustrated in FIG. 8B, a driven shaft 131A of the reader exit driven roller unit 32*b*A provided for the openable guide unit 100 warps. As a result, the exit driven rollers 132*b*A and 132*c*A at the axial center regions are positioned farther by S than the exit driven rollers 132*a*A and 132*d*A relative to a reader exit drive roller unit 32*a*A. Due to such a configuration, the contact pressures of the exit driven rollers 132*b*A and 132*c*A at the axial center regions to exit drive rollers 134*b*A and 134*c*A are reduced. Known exit drive rollers 134*a*A. 134*b*A, 134*c*A, and 134*d*A are mounted on a drive shaft 133A. As a result, the relation of the conveyance forces is expressed as the rollers at the center regions<the rollers at the end regions, in other words, the conveyance force of the rollers at the center regions is smaller than the conveyance force of the rollers at the end regions. Due to such a configuration, it is likely that skew occurs and conveyance of original documents is not stable.

A known ejection driven roller unit mounted on the openable guide unit 100 has the similar inconvenience on the reader exit driven roller unit 32*b*A. Specifically, the driven shaft of the ejection driven roller unit warps due to the deflection of the openable guide unit 100. As a result, the relation of the conveyance forces is expressed as the rollers at the center regions<the rollers at the end regions, in other words, the conveyance force of the rollers at the center regions is smaller than the conveyance force of the rollers at the end regions. Due to such a configuration, skew easily occur, which may result in an unstable conveyance of original documents.

In order to address such inconveniences, the rigidity of the openable guide unit 100 is increased to make the openable guide unit 100 be warped less easily. However, an increase in rigidity of the openable guide unit 100 makes the openable guide unit 100 thicker (i.e., longer in the vertical direction) to contribute to an increase in size of the ADF 20.

For example, it is also conceivable that the driven shaft is divided into at least three portions, i.e., a center region and end regions, and an adjustment mechanism is provided to adjust the biasing forces of respective springs with respect to the divided driven shafts. By adjusting the biasing force by the adjustment mechanism in accordance with the deflection of the openable guide unit, the conveyance force can be maintained at a target conveyance force. However, such a configuration may lead to an increase in cost and size of the ADF due to an increase in the number of parts and components.

In order to address such inconveniences, in the present embodiment, the reader exit driven roller unit 32*b* and the ejection driven roller 37*b* provided for the openable guide unit 100 have the outer diameter of each of the driven rollers at the axial center regions greater than the outer diameter of each of the driven rollers at the axial end regions. In the following description, the reader exit driven roller unit 32*b* will be described. However, the same applies to the ejection driven roller 37*b*.

Figure 9A:
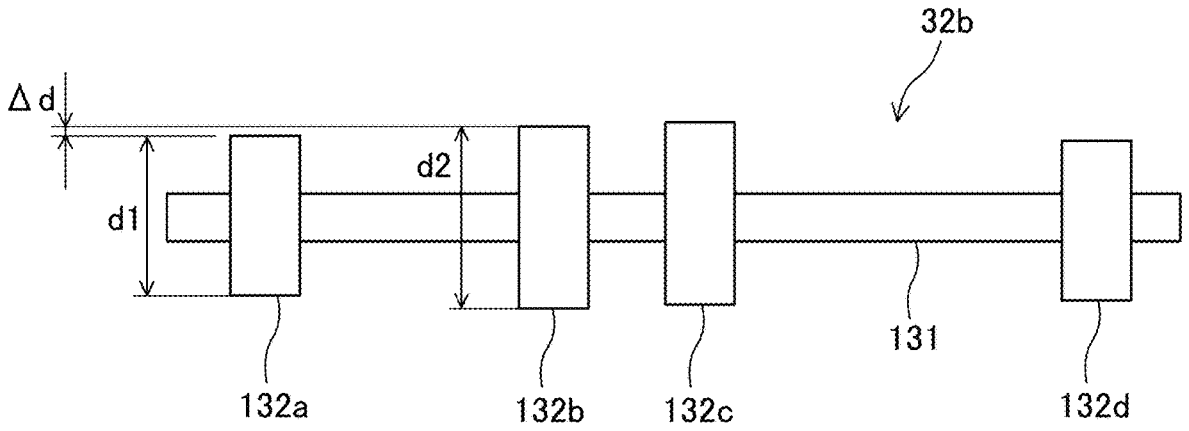
FIGS. 9A and 9B are diagrams each illustrating a reader exit roller pair according to an embodiment of the present disclosure.
Figure 9B:
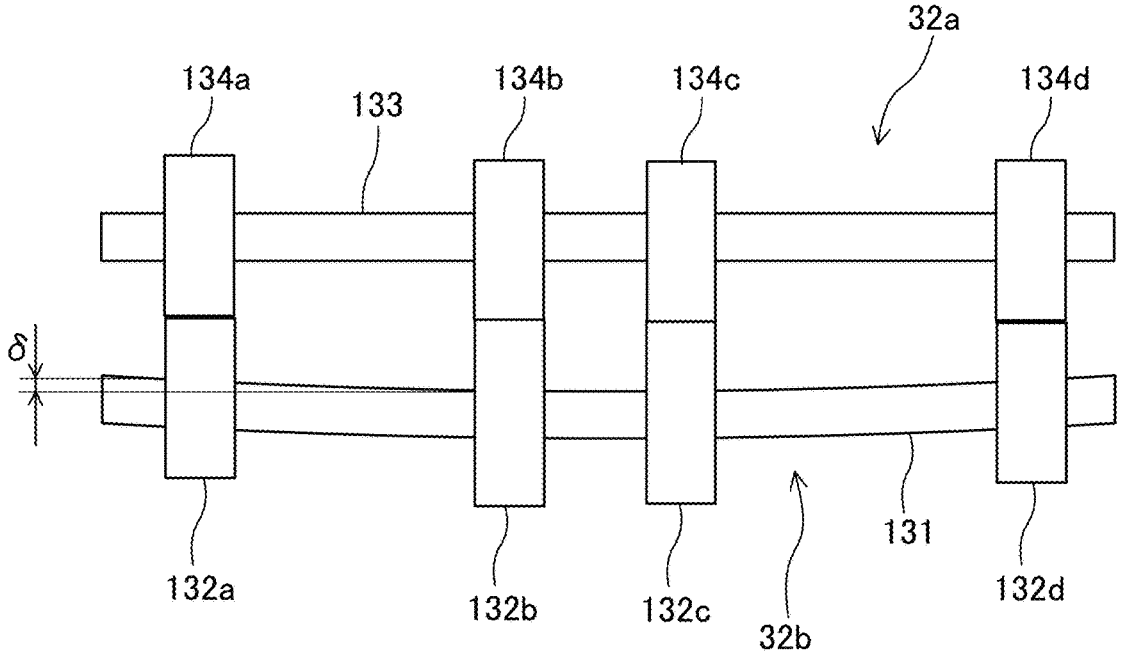

FIGS. 9A and 9B are diagrams each illustrating the reader exit roller pair 32 according to an embodiment of the present disclosure.

Specifically, FIG. 9A illustrates a schematic configuration of the reader exit driven roller unit 32*b* according to the present embodiment, and FIG. 9B illustrates a state where the reader exit driven roller unit 32*b* and the reader exit drive roller unit 32*a* contact when the openable guide unit 100 is warped, according to the present embodiment.

As illustrated in FIG. 9A, in the reader exit driven roller unit 32*b* according to the present embodiment, the outer diameter d2 of each of the exit driven rollers 132*b* and 132*c* at the axial center regions is greater than the outer diameter d1 of each of the exit driven rollers 132*a* and 132*d* at the axial end regions. For this reason, in a state where the driven shaft 131 is not warped, the exit driven rollers 132*b* and 132*c* at the axial center regions of the driven shaft 131 protrude toward the reader exit drive roller unit 32*a* by the difference $\Delta d=(d2-d1)/2$ when compared with the exit driven rollers 132*a* and 132*d* at the axial end regions of the driven shaft 131.

The outer diameter d2 of the exit driven rollers 132*b* and 132*c* at the axial center regions and the outer diameter d1 of the exit driven rollers 132*a* and 132*d* at the axial end regions are set so that the above-described difference Δd equals to the deflection amount S of the driven shaft 131. With this setting, as illustrated in FIG. 9B, even when the driven shaft 131 is warped by the deflection amount S due to the deflection of the openable guide unit 100, a decrease in the contact pressure of the exit driven rollers 132*b* and 132*c* at the axial center regions with respect to the exit drive rollers 134*b* and 134*c* at the axial end regions can be reduced. As a result, the relation of the conveyance forces can be maintained as the conveyance force of the rollers at the axial center regions≥the conveyance force of the rollers at the axial end regions. As a result, occurrence of skew can be prevented, and the original documents can be stably conveyed. Further, when the adjustment mechanism is employed to adjust the biasing force, the conveyance force can be maintained at the target conveyance force with a reasonable (inexpensive) configuration as compared with a configuration in which the relation of the conveyance forces is maintained as the conveyance force of the rollers at the axial center regions the conveyance force of the rollers at the axial end regions.

For example, in a configuration in which the maximum conveyable document width is 297 mm (i.e., an A3-size width), the outer diameter d2 of the exit driven rollers 132*b* and 132*c* at the axial center regions of the driven shaft 131 is set to φ13 mm. Further, the outer diameter d1 of the exit driven rollers 132*a* and 132*d* at the axial end regions of the driven shaft 131 is set to φ11 mm, so that the diameter of the axial center regions is increased by approximately 20% with respect to the diameter of the axial end regions. As a result, in a state where the driven shaft 131 is warped, the relation of the conveyance force of the rollers at the center region: the conveyance force of the rollers at the end region=2:1 is achieved. This relation is merely an example. The outer diameter d2 of the exit driven rollers 132*b* and 132*c* at the axial center regions of the driven shaft 131, the outer diameter d1 of the exit driven rollers 132*a* and 132*d* at the axial end regions of the driven shaft 131, and the ratio of the conveyance forces between the rollers at the end region and the rollers at the center region may be appropriately determined depending on the configuration of the ADF 20 or the image forming apparatus.

In the above description, the drive rotator to which the driven roller of the openable guide unit 100 contacts is a roller unit on which multiple drive rollers are mounted at given intervals. However, the drive rotator may be a belt. In this case, the driven roller is brought into contact with an area of a belt between the drive tension roller and a driven tension roller stretching the belt, to form the conveyance nip region. As the drive rotator is a belt, the conveyance nip width can be increased, and the decrease in the conveyance force at the axial center region of the drive rotator due to the deflection of the openable guide unit 100 can be reduced. Accordingly, an original document can be conveyed more stably.

In the above-description, the ADF 20 that is applied to the present disclosure is described as an example of a sheet conveying device. However, in other embodiments, a conveyor that conveys a recording sheet in the image forming device 15 may be applied to the present disclosure.

The above-described embodiments are limited examples, and the present disclosure includes, for example, the following aspects having advantageous effects.

Aspect 1

In Aspect 1, a sheet conveying device (for example, the document conveying device 27) includes an opening unit (for example, the openable guide unit 100) and a conveyance roller pair (for example, the reader exit roller pair 32). The opening unit is openably closable with respect to the sheet conveying device. The conveyance roller pair conveys a sheet (for example, the original document) and includes a drive rotator (for example, the reader exit drive roller unit 32*a*), and a driven rotator (for example, the reader exit driven roller unit 32*b*) mounted on the opening unit. The drive rotator includes first driven rollers (for example, the exit driven rollers 132*b* and 132*c*) at axial ends and a second driven roller (for example, the exit driven rollers 132*a* and 132*d*) at an axial center. An outer diameter (for example, the outer diameter d2) of the second driven roller at the axial center of the driven rotator is greater than an outer diameter (for example, the outer diameter d1) of each of the first driven rollers at the axial ends of the driven rotator.

To prevent a skew from occurring due to a sheet conveyance load deviation in the axial direction, the driven rotator generally includes multiple divided rollers provided on a driven shaft at given intervals.

Since the opening unit is openably closable with respect to the sheet conveying device, only two positions, which are the axial ends, are generally held by the sheet conveying device, and it is likely that the axial center of the driven shaft is warped in a direction away from the drive rotator. Due to the deflection of this opening member, it is likely that the axial center region of the driven rotator mounted on the opening member is warped in a direction away from the drive rotator. As a result, the pressure force of the driven rotator at the axial center with respect to the drive rotator decreases, and the frictional force (hereinafter, referred to as a conveyance force) between the drive rotator at the axial center and the sheet may become lower than the conveyance force at both axial ends. As described above, as the conveyance force of the driven rotator at the axial center is lower than the conveyance force of the driven rotator at both axial ends, it is likely that the sheet is skewed even with a slight difference between the conveyance force of one axial end and the conveyance force of the other axial end, and the sheet may not be conveyed stably.

In Aspect 1, the outer diameter of the second driven roller at the axial center of the driven rotator is greater than the outer diameter of the first driven rollers at the axial ends of the driven rotator. For this reason, even if the opening unit is warped, the conveyance force at the axial center of the driven rotator is prevented from being lower than the conveyance force at both axial ends of the driven rotator, and the sheet can be stably conveyed.

Aspect 2

In Aspect 2, according to Aspect 1, the drive rotator includes multiple drive rollers (for example, the exit drive rollers 134*a*, 134*b*, 134*c*, and 134*d*) facing the second driven roller (for example, the exit driven rollers 132*a* and 132*d*) at the axial center of the driven rotator (for example, the reader exit driven roller unit 32*b*) and the first driven rollers (for example, the exit driven rollers 132*b* and 132*c*) at the axial ends of the driven rotator, and the drive rollers have a same outer diameter.

According to this configuration, as described in the embodiments above, the circumferential velocity of each of the multiple drive rollers can be made equal to each other, and the conveyance speed of the sheet such as the document sheet can be made equal to each other in the axial direction. Accordingly, occurrence of, for example, wrinkles in the sheet and occurrence of sheet skew can be preferably prevented, and the sheet can be stably conveyed.

Aspect 3

In Aspect 1 or 2, the sheet conveying device further includes a biasing member (for example, the springs 111*a* to 111*f*) to bias the driven rotator (for example, the reader exit driven roller unit 32*b*) toward the drive rotator (for example, the reader exit drive roller unit 32*a*). The opening unit (for example, the openable guide unit 100) includes a guide (for example, the exit lower guide plate 101, the white guide 33, the ejection lower guide plate 102).

According to this configuration, as described in the embodiments above, the sheet can be pressed against the drive rotator (for example, the reader exit drive roller unit 32*a*) by the drive rotator, and a target conveyance force can be obtained.

Further, by opening the opening unit, the guide and the driven rotator are retracted to expose the conveyance passage of the sheet, so that the jammed sheet can be easily removed.

Aspect 4

In Aspect 4, according to any one of Aspects 1 to 3, the axial center of the driven rotator (for example, the reader exit driven roller unit 32*b*) is a conveyance reference of the sheet.

According to this configuration, the first driven rollers (for example, the exit driven rollers 132*b* and 132*c*) are disposed symmetrically with respect to the axial center as a base point. By so doing, the sheet from a small size to a large size can be stably conveyed.

Aspect 5

In Aspect 5, according to any one of Aspects 1 to 4, the multiple driven rollers (for example, the exit driven rollers 132*a*. 132*b*, 132*c*, and 132*d*) of the driven rotator (for example, the reader exit driven roller unit 32*b*) are mounted on a single driven shaft.

According to this configuration, when compared with the multiple divided rollers mounted on the driven shaft, the number of components is reduced, and a reduction in cost of the sheet conveying device can be achieved. Further, when multiple driven rollers such as the multiple exit driven rollers are mounted on a single driven shaft, the driven shaft is longer in the axial direction. Due to such a configuration, the driven shaft may be easily warped due to the deflection of the opening member such as the openable guide unit 100. However, the configuration of Aspect 1 can effectively prevent distortion in conveyance such as skew.

Aspect 6

In Aspect 6, an automatic document feeder (for example, the ADF 20) includes the sheet conveying device (for example, the document conveying device 27) according to Aspects 1 to 5 to convey a document sheet, and an image reader (for example, the image reading unit 16) to read an image on a face of the document sheet conveyed by the sheet conveying device.

According to this configuration, the document sheet can be stably conveyed.

Aspect 7

In Aspect 7, the automatic document feeder (for example, the ADF 20) further includes another image reader (for example, the sheet back face image reading module 35) to read an image formed on another face of the document sheet. Said another face of the document sheet is opposite to the face of the document sheet previously read by the image reader (for example, the image reading unit 16). As the opening unit (for example, the openable guide unit 100) opens, a conveyance passage is opened from an area of conveyance of the document sheet toward said another image reader to an area of conveyance of the document sheet passed through said another image reader.

According to this configuration, as described in the embodiments above, by opening the opening unit (for example, the openable guide unit 100), the glass face of said another image reader (for example, the sheet back face image reading module 35) can be cleaned. Further, the document sheet jammed in the conveyance passages before and after said another image reader can be easily removed.

Aspect 8

In Aspect 8, according to Aspect 7, the opening unit (for example, the openable guide unit 100) includes the driven rotator (for example, the reader exit driven roller unit 32*b*) of the conveyance roller pair (for example, the reader exit roller pair 32) that conveys the document sheet to said another image reader (for example, the sheet back face image reading module 35), and another driven rotator (for example, the ejection driven roller 37*b*) of another conveyance roller pair (for example, the sheet ejection roller pair 37) that conveys the document sheet passed through said another image reader. An outer diameter (for example, the outer diameter d2) of the second driven roller at the axial center of at least one of the driven rotator or said another driven rotator is greater than an outer diameter (for example, the outer diameter d1) of the first driven rollers at the axial ends of the at least one of the driven rotator or said another driven rotator.

According to this configuration, the document sheet can be stably conveyed before and after said another image reader (for example, the sheet back face image reading module 35), and the image formed on the back face of the document sheet can be read by said another image reader with good accuracy.

Aspect 9

In Aspect 9, according to Aspect 7 or 8, said another image reader (for example, the sheet back face image reading module 35) is a contact image sensor.

According to this configuration, as described in the embodiments above, the contact image sensor is used as said another image reader for example, the sheet back face image reading module 35). By so doing, it is highly likely that paper dust or toner adheres to the glass face of said another image reader and the glass face is contaminated. By opening the opening unit, the glass face of said another image reader is exposed to be cleaned. As a result, the image on the back face of the document sheet can be preferably read over a long period by said another image reader.

Aspect 10

In Aspect 10, according to Aspect 9, the document sheet is conveyed to contact said another image reader (for example, the sheet back face image reading module 35).

According to this configuration, the image on the back face of the document sheet can be preferably read by the contact image sensor.

Aspect 11

In Aspect 11, an image forming apparatus (for example, the image forming apparatus 1) includes the sheet conveying device (for example, the document conveying device 27) according to any one of Aspects 1 to 5 to convey a sheet or the automatic document feeder (for example, the ADF 20) according to any one of Aspects 6 to 10 to convey a sheet, and an image former (for example, the image forming device 15) to form an image on the sheet conveyed by the sheet conveying device.

According to this configuration, the document sheet can be stably conveyed.

Aspect 12

In Aspect 12, a sheet conveying device (for example, the document conveying device 27) includes a housing (for example, the housing 50), an opening unit (for example, the openable guide unit 100), and a drive rotator (for example, the reader exit drive roller unit 32*a* 32*a*). The opening unit is openably close the housing. The opening unit includes a driven rotator (for example, the reader exit driven roller unit 32*b*) including first driven rollers (for example, the exit driven rollers 132*b* and 132*c*) at each end regions of an axis of the driven rotator, and a second driven roller (for example, the exit driven rollers 132*a* and 132*d*) at a center region of the axis. The drive rotator forms a conveyance roller pair (for example, the reader exit roller pair 32) with the driven rotator to convey a sheet. The second driven roller has an outer diameter (for example, the outer diameter d2) greater than each of the first driven rollers.

Aspect 13

In Aspect 13, according to Aspect 12, the drive rotator includes multiple drive rollers (for example, the exit drive rollers 134*a*, 134*b*. 134*c*, and 134*d*) respectively facing the first driven rollers (for example, the exit driven rollers 132*b* and 132*c*) and the second driven roller (for example, the exit driven rollers 132*a* and 132*d*), and the multiple drive rollers have an identical outer diameter.

Aspect 14

In Aspect 14, according to Aspect 12 or 13, the sheet conveying device (for example, the document conveying device 27) further includes a biasing member (for example, the springs 111*a* to 111*f*) to bias the driven rotator toward the drive rotator. The opening unit (for example, the openable guide unit 100) includes a guide (for example, the exit lower guide plate 101, the white guide 33, the ejection lower guide plate 102) to guide the sheet.

Aspect 15

In Aspect 15, according to any one of Aspects 12 to 14, the first driven rollers (for example, the exit driven rollers 132*b* and 132*c*) and the second driven roller (for example, the exit driven rollers 132*a* and 132*d*) are disposed symmetrically with respect to a center of the axes.

Aspect 16

In Aspect 16, according to any one of Aspects 12 to 15, the first driven rollers (for example, the exit driven rollers 132*b* and 132*c*) and the second driven roller (for example, the exit driven rollers 132*a* and 132*d*) are rotatable around a single driven shaft as the axis.

Aspect 17

In Aspect 17, an automatic document feeder (for example, the ADF 20) includes the sheet conveying device (for example, the document conveying device 27) according to Aspects 12 to 16 to convey a document sheet, and an image reader (for example, the image reading unit 16) to read an image on a face of the document sheet conveyed by the sheet conveying device.

Aspect 18

In Aspect 18, the automatic document feeder (for example, the ADF 20) according to Aspect 17 further includes another image reader (for example, the sheet back face image reading module 35) to read an image formed on another face of the document sheet. Said another face of the document sheet is opposite to the face of the document sheet previously read by the image reader (for example, the image reading unit 16). The opening unit (for example, the openable guide unit 100) is opened to open a conveyance passage from a first position downstream of the image reader and upstream of the driven rotator to a second position downstream of said another image reader.

Aspect 19

In Aspect 19, the automatic document feeder (for example, the ADF 20) according to Aspect 18 further includes another driven rotator (for example, the ejection driven roller 37*b*) to convey the document sheet passed through said another image reader (for example, the sheet back face image reading module 35). The driven rotator (for example, the reader exit driven roller unit 32*b*) conveys the document sheet to said another image reader. Said another driven rotator includes the first driven rollers (for example, the exit driven rollers 132*b* and 132*c*) and the second driven roller (for example, the exit driven rollers 132*a* and 132*d*).

Aspect 20

In Aspect 20, according to Aspect 18 or 19, according to Aspect 18 or 19, said another image reader (for example, the sheet back face image reading module 35) is a contact image sensor.

Aspect 21

In Aspect 21, according to Aspect 20, the document sheet is conveyed to contact said another image reader (for example, the sheet back face image reading module 35).

Aspect 22

In Aspect 22, an image forming apparatus (for example, the image forming apparatus 1) includes the automatic document feeder (for example, the ADF 20) according to any one of Aspects 17 to 21 to convey a sheet, and an image former (for example, the image forming device 15) to form an image on the sheet conveyed by the sheet conveying device.

Aspect 23

In Aspect 23, an image forming apparatus (for example, the image forming apparatus 1) includes the sheet conveying device (for example, the document conveying device 27) according to any one of Aspects 12 to 16 to convey a sheet, and an image former (for example, the image forming device 15) to form an image on the sheet conveyed by the sheet conveying device.

The present disclosure is not limited to specific embodiments described above, and numerous additional modifications and variations are possible in light of the teachings within the technical scope of the appended claims. While the above-described embodiments are preferred examples, those skilled in the art will readily conceive various modifications from those disclosed herein. Such modifications are also included in the technical scope of the present disclosure.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a housing;

an opening unit including a group of rotators to openably close the housing, the group of rotators to convey a sheet to a given position, wherein the group of rotators is opened to open a conveyance passage from a first position upstream of the given position to a second position downstream of the given position, the group of rotators including:

a first driven rotator to convey the sheet to the given position, the first driven rotator including:

first driven rollers at end region of an axis of the first driven rotator, the axis of the first driven roller being a first axis; and a second driven roller at a center region of the first axis, a second driven rotator to convey the sheet after the sheet passes through the given position, the second driven rotator including:

third driven rollers at each end region of an axis of the second driven rotator, the axis of the third driven rollers being a second axis; and a fourth driven roller at a center region of the second axis; and a drive rotator to form a conveyance roller pair with the first driven rotator to convey the sheet, wherein the second driven roller has an outer diameter greater than each of the first driven rollers.

2. The sheet conveying device according to claim 1, wherein:

the drive rotator includes multiple drive rollers respectively facing the first driven rollers and the second driven roller, and the multiple drive rollers have an identical outer diameter.

3. The sheet conveying device according to claim 1, further comprising:

a biaser to bias the first driven rotator toward the drive rotator, wherein the opening unit includes a guide to guide the sheet.

4. The sheet conveying device according to claim 1, wherein:

the first driven rollers and the second driven roller are disposed symmetrically with respect to a center of the first axis.

5. An automatic document feeder comprising:

the sheet conveying device according to claim 1 to convey a document sheet; and an image reader to read an image on a face of the document sheet conveyed by the sheet conveying device.

6. The automatic document feeder according to claim 5, further comprising:

a second image reader to read an image formed on another face of the document sheet, the another face being opposite to the face of the document sheet previously read by the image reader, wherein the opening unit is opened to open a conveyance passage from the first position which is downstream of the image reader and upstream of the first driven rotator to the second position which is downstream of the second image reader.

7. The automatic document feeder according to claim 6, wherein:

the second driven rotator conveys the document sheet to the second image reader.

8. The automatic document feeder according to claim 5, further comprising:

a second image reader to read an image formed on another face of the document sheet, the another face being opposite to the face of the document sheet previously read by the image reader, wherein the second image reader is a contact image sensor.

9. The automatic document feeder according to claim 8, wherein:

the document sheet is conveyed to contact the second image reader.

10. An image forming apparatus comprising:

the sheet conveying device according to claim 1 to convey a sheet; and an image former to form an image on the sheet conveyed by the sheet conveying device.

11. The sheet conveying device according to claim 1, wherein:

the fourth driven roller has an outer diameter greater than each of the third driven rollers.

* * * * *